US005676413A

United States Patent [19]

Hauck

[11] Patent Number: 5,676,413

[45] Date of Patent: Oct. 14, 1997

[54] ROOF SNOW RAKE BLADE

[75] Inventor: Charles J. Hauck, Inver Grove Heights, Minn.

[73] Assignee: Garelick Mfg. Co., St. Paul Park, Minn.

[21] Appl. No.: 639,471

[22] Filed: Apr. 29, 1996

[51] Int. Cl.[6] ..... E01H 5/02

[52] U.S. Cl. ..... 294/54.5; 37/285; 294/59

[58] Field of Search ..... 294/49, 51, 54.5, 294/55, 56, 59; 37/241, 265, 266, 284, 285, 434; 56/400.01, 400.04, 400.13–400.15; 172/371, 381; 254/131.5; 280/8, 28.5; 301/1, 111, 125

[56] References Cited

U.S. PATENT DOCUMENTS

| | | | |
|---|---|---|---|
| 928,283 | 7/1909 | Schultze | 294/49 |
| 2,772,490 | 12/1956 | Hastchenko | 37/284 |
| 2,790,297 | 4/1957 | Gardner | 56/400.14 |
| 3,218,738 | 11/1965 | Bowerman | 294/54.5 X |
| 4,386,474 | 6/1983 | Mechavich et al. | 294/54.5 X |
| 4,804,219 | 2/1989 | Berg | 294/54.5 |
| 4,865,373 | 9/1989 | Hudson | 294/54.5 |
| 5,465,510 | 11/1995 | Goodnough et al. | 294/54.5 X |

*Primary Examiner*—Johnny D. Cherry

*Attorney, Agent, or Firm*—Jacobson and Johnson

[57] ABSTRACT

A roof snow rake blade has a spacer, preferably in the form of a roller, attached at its bottom edge to space the bottom edge away from the roofing while not interfering with the normal snow-removal function of the blade.

4 Claims, 2 Drawing Sheets

ROOF SNOW RAKE BLADE

FIELD OF THE INVENTION

The invention is directed toward a roof snow rake blade which comprises a generally rectangular sheet of stiff material, usually metal such as aluminum, and a lower edge which is inserted into the snow on the rooftop down toward the roof. The user then pulls on an attached elongated handle to remove snow from the rooftop in a scraping or raking action.

DESCRIPTION OF THE PRIOR ART

The prior art is in the form of commercially available roof snow rake blades. The difficulty encountered with the prior art blades is that when the lower edge is inserted into the snow on the top of the roof it usually contacts the roofing material and when the blade is moved the lower edge of the blade can and often does damage the roofing material.

SUMMARY OF THE INVENTION

A spacer is provided at the lower edge of the roof snow rake blade to prevent the lower edge of the blade from striking the roof material to thereby eliminate or at least minimize danger of the roofing being damaged by the blade. Preferably the spacer is in the form of a cylindrical roller which is attached along the lower edge of the blade so that it spaces the lower edge a little above the roofing and yet does not interfere with nor impede the normal action of the blade when it is pulled by the handle to remove the snow from the rooftop.

DESCRIPTION OF THE PREFERRED EMBODIMENTS

Figures 1, 2:
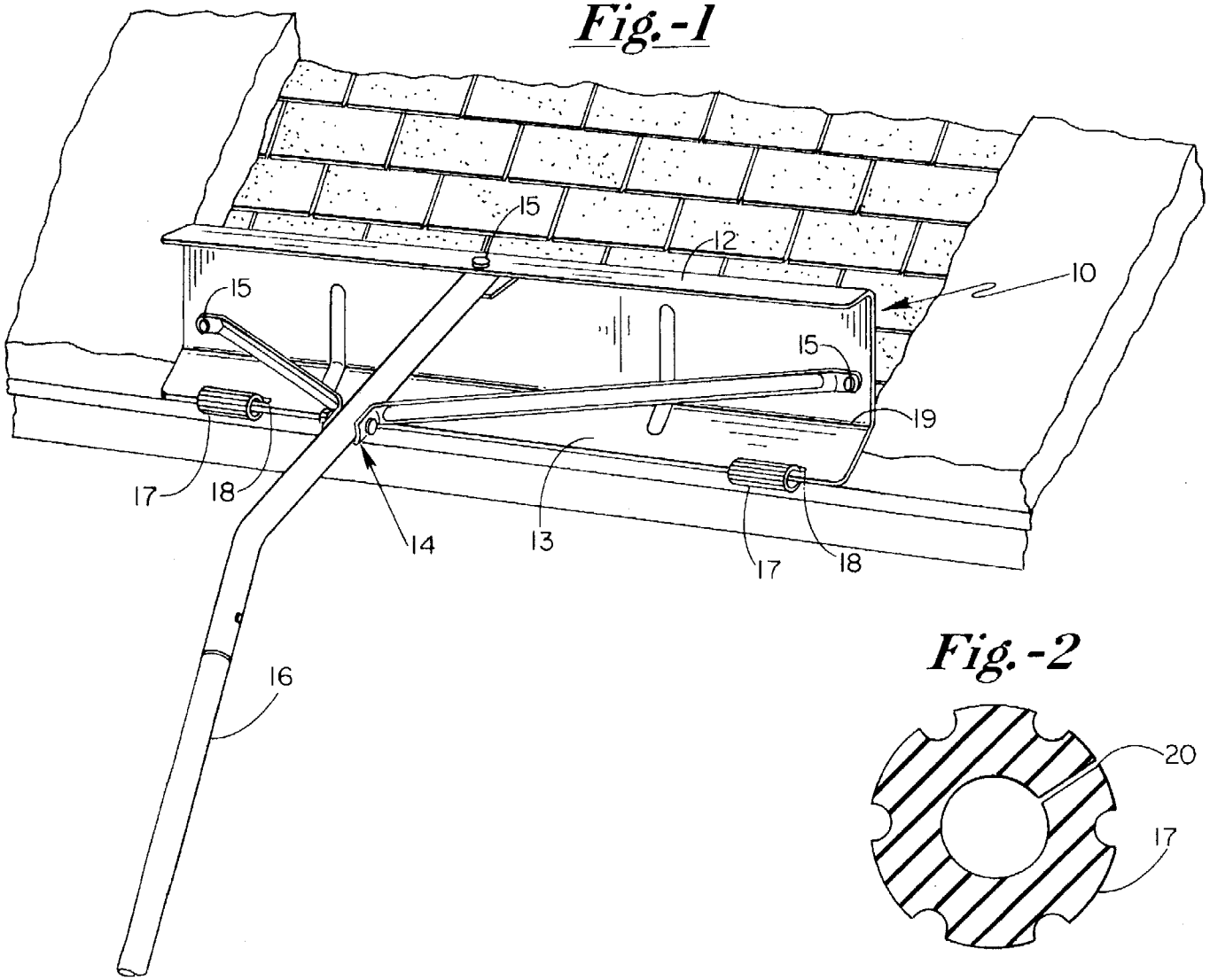
FIG. 1 is an illustration of the operation of the invention.
FIG. 2 is a section view of a preferred form of spacer used in the invention.
Figure 3:
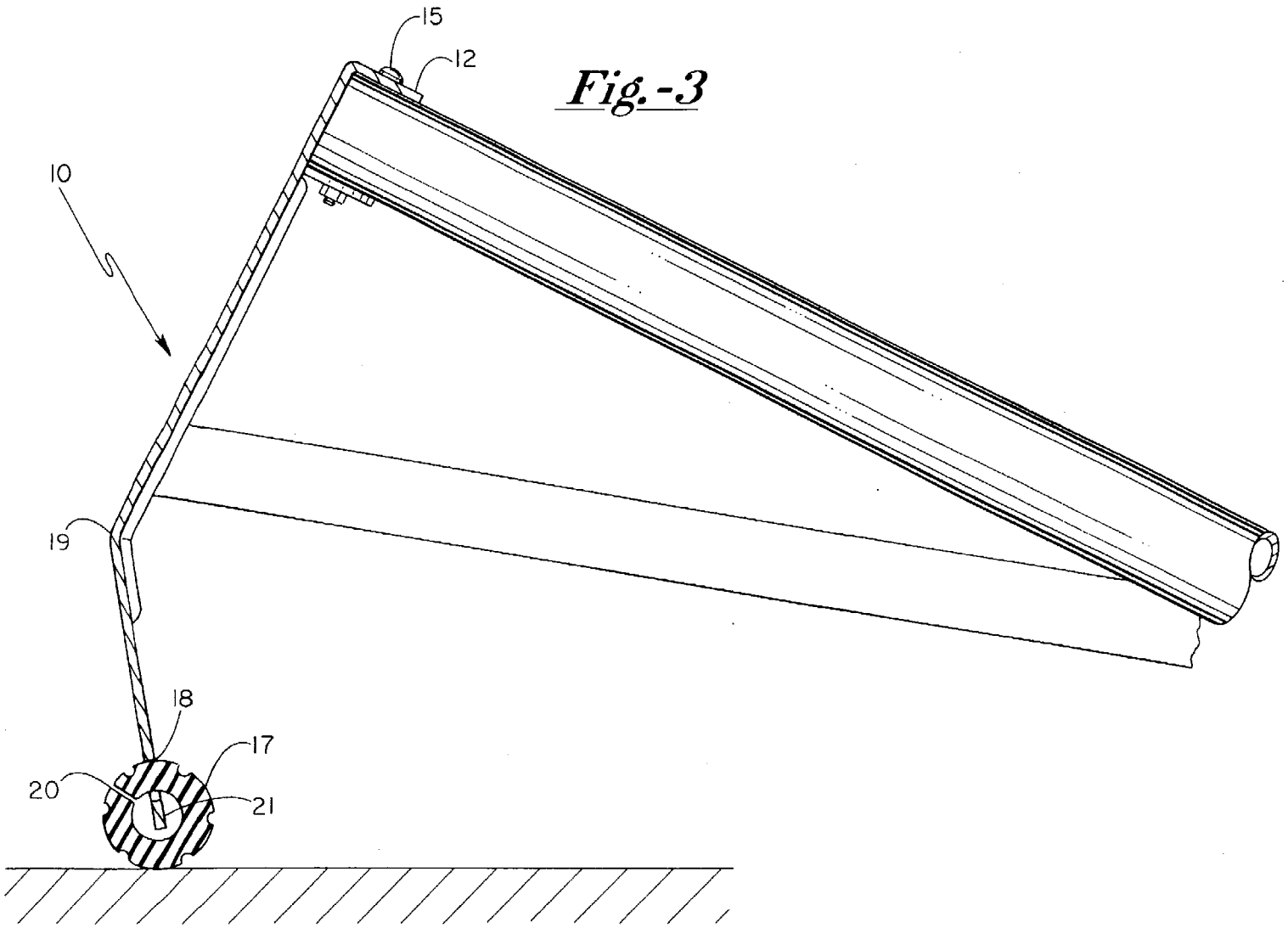
FIG. 3 is a section view of the preferred form of the invention as it would appear in use.

Conventionally a blade 10 for a roof snow rake is a generally rectangular sheet of metal, preferably aluminum because it is lightweight and noncorrosive. The blade may have a flange 12 along its upper edge and its lower part may be angled as at 19 and terminates in a bottom elongated edge 13. A three-legged handle attachment 14 is seemly attached to the blade 10 by rivets or screws at 15. The handle attachment 14 is made of tubular rigid metal also preferably aluminum because of its characteristics. An elongated handle 16, which can be made of separate section, is generally removably attached to handle 14. In use, the user normally stands alongside the building and moves the attached handle 16 to raise the blade 10 over the snow on top of the roof and then drops the blade so that the lower edge

13 penetrates into the snow toward the roof. The operator then pulls the blade with the handle to bring the snow down off the edge of the roof. As mentioned earlier, lower edge 13 not uncommonly strikes the roofing, such as roofing shingles, and oftentimes damages the roofing by scraping pieces off or by scraping off some of the roofing material. To eliminate or at least minimize the damage that blade 10 causes, the instant invention provides a spacer located at the lower edge of the blade to provide a small gap or space between lower edge 13 and the rooftop. This prevents the lower edge from contacting the roof yet does not impede the normal snow-removal function of the blade. Preferably the spacer comprises a pair of generally cylindrical rollers 17 blade 10 just above lower edge 13 and rollers 17 are mounted so that the axes of the rollers generally coincide with lower edge 13. Preferably the rollers are made out of some durable plastic or hard rubber material with a split 20 through the roller parallel to its axis so that the roller can be inserted over the edge 13 into the slot through the split in the roller. The little band or strip of metal 21 constituting the lower edge of the blade when slob 18 are formed serves as an axle for the rollers. Rollers 17 then provide suitable spacing between the lower edge 13 and the roofing material so that the lower edge does not contact the roof thereby eliminating damage to the roofing material caused by scraping the edge 13 of blade 10 over the roofing material while not interfering with nor impeding the normal snow removal function of the blade.

I claim:

1. A roof snow rake blade comprising:

a sheet of stiff metal having a lower elongated edge for inserting down into the snow on top of a roof toward the roof;

an opening formed in the blade just above the lower edge of said sheet of metal; and roller means in said opening rotatably attached along its axis to the lower edge of said sheet so that the roller means spaces the lower edge away from the roof top.

2. The roof snow rake blade as described in claim 1 wherein said roller means is annular and radially slotted for insertion of said roller means into said opening.

3. A roof snow rake blade comprising:

a sheet of stiff metal having a lower elongated edge for inserting down into the snow on top of a roof;

plural openings formed in the blade adjacent the lower edge;

rollers in said openings rotatably attached along their axes to said lower edge for spacing the lower edge away from the roof top.

4. The roof snow rake blade as described in claim 3 wherein said rollers are annular and are radially slotted for inserting the lower edge of the blade into the center opening of the rollers.

* * * * *